US012365972B2

(12) United States Patent
Kim et al.

(10) Patent No.: US 12,365,972 B2
(45) Date of Patent: Jul. 22, 2025

(54) NON-MAGNETIC AUSTENITIC STAINLESS STEEL

(71) Applicant: POSCO, Pohang-si (KR)

(72) Inventors: Kyunghun Kim, Pohang-si (KR); Hak Kim, Pohang-si (KR); Jisoo Kim, Pohang-si (KR); Jongjin Jeon, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 490 days.

(21) Appl. No.: 17/624,969

(22) PCT Filed: Dec. 30, 2020

(86) PCT No.: PCT/KR2020/019437
§ 371 (c)(1),
(2) Date: Jan. 5, 2022

(87) PCT Pub. No.: WO2022/145539
PCT Pub. Date: Jul. 7, 2022

(65) Prior Publication Data

US 2023/0151470 A1 May 18, 2023

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/02* (2013.01); *C22C 38/42* (2013.01); *C22C 38/44* (2013.01)

(58) Field of Classification Search
CPC ..... C22C 38/08; C22C 38/18; C22C 38/40; C22C 38/42
See application file for complete search history.

(56) References Cited

U.S. PATENT DOCUMENTS 4,675,156 A * 6/1987 Sakamoto ..... C22C 38/58 420/44
5,087,414 A 2/1992 Maniar
(Continued)

FOREIGN PATENT DOCUMENTS

CN 1788100 A 6/2006
CN 103924160 A 7/2014
(Continued)

OTHER PUBLICATIONS

Priestner et al. ("Processing of steel for ultrafine ferrite grain structures." Materials Science and Technology 16.11-12 (2000): 1267-1272.) (Year: 2000).*
JP-2001254146-A english translation (Year: 2001).*
European Communication dated Aug. 19, 2022 issued in European Patent Application No. 20942436.5.
(Continued)

*Primary Examiner* — Ricardo D Morales
(74) *Attorney, Agent, or Firm* — Morgan Lewis & Bockius LLP

(57) ABSTRACT

Provided is a non-magnetic austenitic stainless steel. According to an embodiment of the disclosed non-magnetic austenitic stainless steel, the non-magnetic austenitic stainless steel includes, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities, wherein a value of Expression (1) below is a negative value: (1) 3*(Cr+Mo)+5*Si−65*(C+N)−2*(Ni+Mn)−28, wherein in Expression (1), Cr, Mo, Si, C, N, Ni, and Mn denote contents (wt %) of the alloy elements, respectively.

2 Claims, 2 Drawing Sheets

(51) Int. Cl.

| | |
|---|---|
| ***C22C 38/02*** | (2006.01) |
| ***C22C 38/42*** | (2006.01) |
| ***C22C 38/44*** | (2006.01) |

(56) References Cited

U.S. PATENT DOCUMENTS

| | | | |
|---|---|---|---|
| 5,328,529 | A | 7/1994 | Cordea et al. |
| 2020/0299816 | A1 | 9/2020 | Kim et al. |

FOREIGN PATENT DOCUMENTS

| | | | | |
|---|---|---|---|---|
| CN | 110819893 | A | | 2/2020 |
| CN | 111373067 | A | | 7/2020 |
| JP | S5798625 | A | | 6/1982 |
| JP | 61-52351 | A | | 3/1986 |
| JP | H07-113144 | A | | 5/1995 |
| JP | H08-269564 | A | | 10/1996 |
| JP | 2001254146 | A | * | 9/2001 |
| JP | 2003-082445 | A | | 3/2003 |
| KR | 10-2015-0121061 | A | | 10/2015 |
| KR | 10-1623290 | B1 | | 5/2016 |
| KR | 10-2019-0066737 | A | | 6/2019 |
| KR | 10-2020-0054779 | A | | 5/2020 |
| KR | 10-2021-0008732 | A | | 1/2021 |
| WO | 2020/101226 | A1 | | 5/2020 |
| WO | 2020/101227 | A1 | | 5/2020 |

OTHER PUBLICATIONS

Extended European Search Report dated Aug. 1, 2022 issued in European Patent Application No. 20942436.5.
Notice of Reasons for Refusal issued May 9, 2023 for corresponding Japanese Patent Application No. 2022-502544 (See English Translation).
Office Action issued Jul. 6, 2023 for corresponding Chinese Patent Application No. 202080050984.8 (See English Translation).
Japanese Office Action dated Oct. 17, 2023 issued in Japanese Patent No. 2022-502544 (with English translation).
International Search Report dated Sep. 24, 2021 issued in International Patent Application No. PCT/KR2020/019437.
Japanese Notice of Allowance dated Apr. 15, 2021 issued in Japanese Patent Application No. 10-2019-0085271.
Japanese Office Action dated Nov. 13, 2020 issued in Japanese Patent Application No. 10-2019-0085271.
Chinese Office Action dated Feb. 11, 2023 issued in Chinese Patent Application No. 202080050984.8 (with English translation).
Office Action issued Feb. 20, 2024 for Indian Patent Application No. 202217000149 (See Partial Translation).
Indian Notice of Hearing dated Feb. 17, 2025 issued in Indian Patent Application No. 202217000149 (with partial English translation).
Japanese Office Action dated Apr. 15, 2025 issued in Japanese Patent Application No. 2024-2902 (with English translation).
Japanese Decision of Dismissal of Amendment dated Apr. 15, 2025 issued in Patent Application No. 2024-2902 (with English translation).

* cited by examiner

【FIGURE 1】
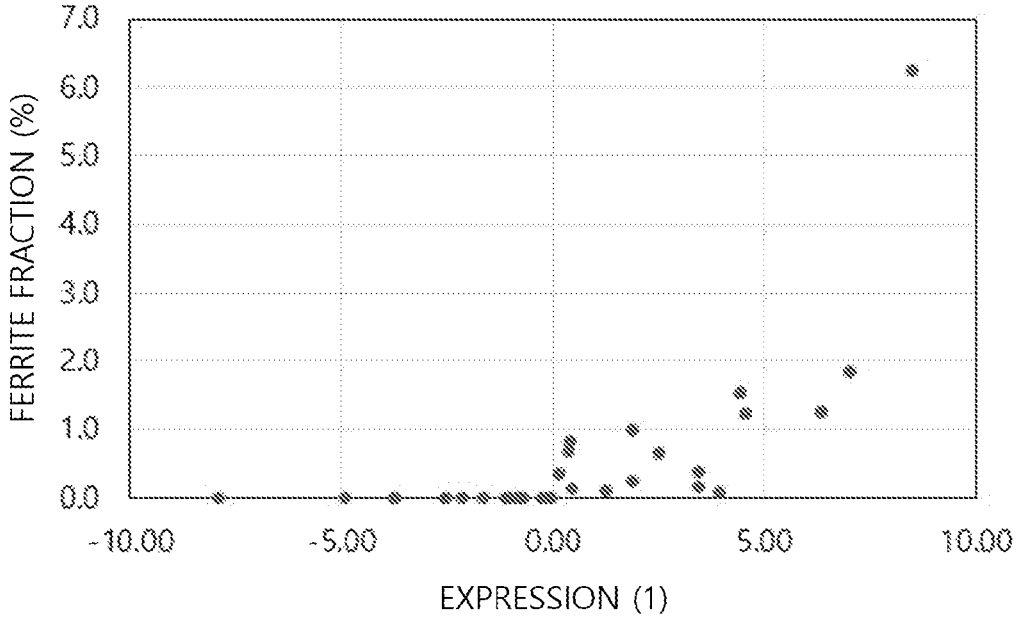

【FIGURE 2】
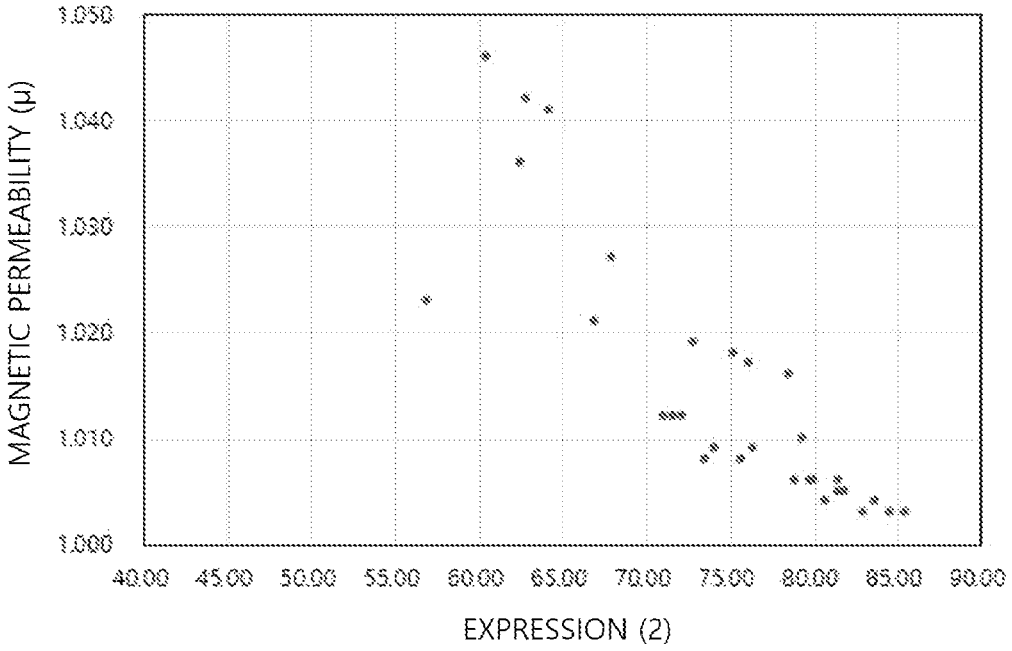

NON-MAGNETIC AUSTENITIC STAINLESS STEEL

CROSS-REFERENCE OF RELATED APPLICATIONS

This application is the U.S. National Phase under 35 U.S.C. § 371 of International Patent Application No. PCT/KR2020/019437, filed on Dec. 30, 2020, the entire disclosure of which application is incorporated by reference herein.

TECHNICAL FIELD

The present disclosure relates to a non-magnetic austenitic stainless steel, and more particularly, to a non-magnetic austenitic stainless steel applicable as a material for various electronic devices.

BACKGROUND ART

As smart devices with various functions have been used in recent years, there have been increasing demands for steel materials having reduced magnetic properties to prevent loss of electric power and malfunction. 300 series stainless steels including an austenite phase as a main structure generally have non-magnetic properties and thus they have been widely used as materials for electronic devices.

However, common STS304 or STS316 austenitic stainless steels have a δ-ferrite fraction of 1 to 5% during a steelmaking/continuous casting process. The δ-ferrite formed as described above has a structures inducing magnetism, causing a problem in that a final product has magnetic properties. Therefore, these common STS304 and STS316 austenitic stainless steels could not have non-magnetic properties due to the δ-ferrite.

The δ-ferrite may be decomposed by heat treatment in a temperature range of 1,300 to 1,400° C. However, δ-ferrite may remain in the structure without being completely removed during rolling and annealing processes and thus magnetic properties may be enhanced by the remaining ferrite, failing to obtain non-magnetic properties.

DISCLOSURE

Technical Problem

The present disclosure provides a non-magnetic austenitic stainless steel applicable as a material for various electronic devices to solve the above-described problems.

Technical Solution

One aspect of the present disclosure provides a non-magnetic austenitic stainless steel including, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities, wherein a value of Expression (1) below is a negative value.

$$3*(Cr+Mo)+5*Si-65*(C+N)-2*(Ni+Mn)-28 \quad (1)$$

In Expression (1), Cr, Mo, Si, C, N, Ni, and Mn denote contents (wt %) of the alloy elements, respectively.

The non-magnetic austenitic stainless steel may further include, in percent by weight (wt %), 2.5% or less of copper (Cu).

Another aspect of the present disclosure provides a non-magnetic austenitic stainless steel including, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities, wherein a value of Expression (2) below is 70 or more.

$$\Sigma A_5/\Sigma A \times 100 \quad (2)$$

In Expression (2), $\Sigma A_5$ is a sum of areas of ferrite grains having an area of 5 $\mu m^2$ or less, and $\Sigma A$ is a sum of areas of all ferrite grains.

The non-magnetic austenitic stainless steel may further include, in percent by weight (wt %), 2.5% or less of copper (Cu).

In each of the non-magnetic austenitic stainless steels, a magnetic permeability may be 1.02 or less when a thickness is 1 mm or less.

Advantageous Effects

According to the present disclosure, a non-magnetic austenitic stainless steel applicable as a material for various electronic devices may be provided by lowering a fraction of a ferrite phase that induces magnetism.

According to the present disclosure, the fraction of the ferrite phase may be lowered by inhibiting formation of ferrite via adjustment of alloy components or by accelerating decomposition of ferrite by controlling a microstructure thereof.

DESCRIPTION OF DRAWINGS

FIG. 1 is a graph illustrating changes in ferrite fractions according to values of Expression (1) of Table 1.

FIG. 2 is a graph illustrating changes in magnetic permeability according to values of Expression (2) of Table 2.

BEST MODE

A non-magnetic austenitic stainless steel according to an embodiment of the present disclosure includes, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities, wherein a value of Expression (1) below is a negative value.

$$3*(Cr+Mo)+5*Si-65*(C+N)-2*(Ni+Mn)-28 \quad (1)$$

In Expression (1), Cr, Mo, Si, C, N, Ni, and Mn denote contents (wt %) of the elements, respectively).

Mode of the Invention

Preferred embodiments of the present disclosure will now be described. However, the present disclosure may be embodied in many different forms and should not be construed as being limited to the embodiments set forth herein. Rather, these embodiments are provided so that this disclosure will be thorough and complete, and will fully convey the scope of the disclosure to those skilled in the art.

The terms used herein are merely used to describe particular embodiments. Thus, an expression used in the singular encompasses the expression of the plural, unless it has a clearly different meaning in the context. In addition, it is to be understood that the terms such as "including" or "having," etc., are intended to indicate the existence of features, steps, functions, components, or combinations thereof disclosed in the specification, and are not intended to preclude the possibility that one or more other features, steps, functions, components, or combinations thereof may exist or may be added.

Meanwhile, unless otherwise defined, all terms used herein have the same meaning as commonly understood by one of ordinary skill in the art to which this disclosure belongs. Thus, these terms should not be interpreted in an idealized or overly formal sense unless expressly so defined herein. As used herein, the singular forms are intended to include the plural forms as well, unless the context clearly indicates otherwise.

In addition, the terms "about", "substantially", etc. used throughout the specification mean that when a natural manufacturing and substance allowable error are suggested, such an allowable error corresponds a value or is similar to the value, and such values are intended for the sake of clear understanding of the present invention or to prevent an unconscious infringer from illegally using the disclosure of the present invention.

A non-magnetic austenitic stainless steel according to an embodiment of the present disclosure may include, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities. The non-magnetic austenitic stainless steel may further include 2.5% or less of copper (Cu).

Hereinafter, reasons for numerical limitations on the contents of alloy components in the embodiment of the present disclosure will be described. Hereinafter, the unit is wt % unless otherwise stated.

Carbon (C): 0.01 to 0.1 wt %

C is an element with powerful effects on stabilizing an austenite phase and inhibiting an increase in magnetism during a solidification process. In the present disclosure, C may be added in an amount of 0.01 wt % or more for the effects on stabilizing the austenite phase. However, when the C content is excessive, C binds to Cr to form a carbide and a Cr content is locally lowered around grain boundaries, resulting in deterioration of corrosion resistance. Therefore, an upper limit of the C content may be set to 0.1 wt % in the present disclosure to obtain sufficient corrosion resistance.

Silicon (Si): 1.5 wt % or Less (Excluding 0)

Si is an element enhancing corrosion resistance. However, Si is an element stabilizing a ferrite phase that induces magnetism. An excess of Si may promote precipitation of intermetallic compounds such as delta (δ) phase, thereby deteriorating mechanical properties and corrosion resistance. Therefore, an upper limit of the Si content may be set to 1.5 wt % in the present disclosure.

Manganese (Mn): 0.5 to 3.5 wt %

Mn is an element stabilizing an austenite phase like C and Ni and is effective on enhancing non-magnetic properties. Accordingly, Mn may be added in an amount of 0.5 wt % or more in the present disclosure. However, an excess of Mn may form inclusions such as MnS, thereby deteriorating corrosion resistance and surface gloss. Therefore, an upper limit of the Mn content may be set to 3.5 wt % in the present disclosure.

Chromium (Cr): 16 to 22 wt %

Cr is a representative element effective on enhancing corrosion resistance of stainless steels and may be added in an amount of 16 wt % in the present disclosure to obtain sufficient corrosion resistance. However, Cr is an element stabilizing a ferrite phase that induces magnetism. In addition, when the Cr content is excessive, a large amount of Ni needs to be added to obtain non-magnetic properties, so that manufacturing costs increase and formation of σ-phase is promoted, resulting in deterioration of mechanical properties and corrosion resistance. Therefore, an upper limit of the Cr content may be set to 22 wt %.

Nickel (Ni): 7 to 15 wt %

Ni is an element with the most powerful effects on stabilizing an austenite phase and may be added in an amount of 7 wt % or more in the present disclosure to obtain non-magnetic properties. However, as the Ni content increases, costs for raw materials increase, and thus an upper limit of the Ni content may be set to 15 wt %.

Molybdenum (Mo): 3 wt % or Less

Mo is an element enhancing corrosion resistance. However, Mo is an element stabilizing a ferrite phase and an excess of Mo promotes formation of a a-phase, thereby deteriorating mechanical properties and corrosion resistance. Therefore, an upper limit of the Mo content may be set to 3 wt %.

Nitrogen (N): 0.01 to 0.3 wt %

N is an austenite phase-stabilizing element and may be added in an amount of 0.01 wt % or more in the present disclosure to obtain non-magnetic properties. However, an excess of N may deteriorate hot processibility of steels and surface quality. Therefore, an upper limit of the N content may be set to 0.3 wt %.

The non-magnetic austenitic stainless steel according to an embodiment of the present disclosure may further, optionally include 2.5 wt % or less of copper (Cu). In the following descriptions, the reason for numerical limitations on the Cu content will be described in detail.

Copper (Cu): 2.5 wt % or Less

Cu is an austenite phase-stabilizing element and may be used to replace expensive Ni. However, an excess of Cu may deteriorate hot processibility by forming a phase having a low melting point, thereby deteriorating surface quality. Therefore, an upper limit of the Cu content may be set to 2.5 wt % or less.

The remaining component of the austenitic stainless steel of the present disclosure is iron (Fe). However, in common manufacturing processes, undesired impurities from raw materials or manufacturing environments may be inevitably mixed therewith, and this cannot be excluded. Such impurities are well-known to those of ordinary skill in the art, and thus, specific descriptions thereof will not be given in the present disclosure.

In general, STS 304 or 316 stainless steels are formed of an austenite phase as a main structure and have a microstructure in which a ferrite phase formed during a steelmaking/continuous casting process remains. The austenite phase having a face-centered cubic structure is not magnetic but the ferrite phase having a body-centered cubic structure is magnetic. That is, depending on the fraction of the remaining ferrite phase, it may be difficult to obtain non-magnetic properties desired by the present disclosure. Accordingly, the fraction of the ferrite phase that induces magnetism should be decreased as low as possible to obtain non-magnetic properties. Hereinafter, technical methods for obtaining non-magnetic properties desired by the present disclosure will be described in detail.

Control of Alloy Components

A composition of alloy components significantly affects a fraction of an initially formed ferrite phase. For example, austenite phase-stabilizing elements such as Ni, Mn, C, and N reduce the fraction of the ferrite phase and some elements such as Cr and Mo increase the fraction of the ferrite phase. The present inventors have derived Expression (1) below used to control the fraction of the ferrite phase in consideration of the above-described properties.

$$3*(Cr+Mo)+5*Si-65*(C+N)-2*(Ni+Mn)-28 \quad (1)$$

In Expression (1), Cr, Mo, Si, C, N, Ni, and Mn denote contents (wt %) of the alloy elements, respectively.

According to the present disclosure, when a value of Expression (1) is a negative value, a fraction of the initially formed ferrite phase may be 0%.

Microstructure Control

Meanwhile, the ferrite phase remaining during a steelmaking/continuous casting process may be decomposed by heat treatment performed later. The present inventors have found that decomposition of the ferrite phase may be accelerated during a heat treatment process by controlling a microstructure even when the ferrite phase remains by a positive value of Expression (1) and thus a steel has magnetic properties. The acceleration of decomposition of the ferrite phase is related to size distribution of the remaining ferrite phase, and Expression (2) was derived by analysis.

$$\Sigma A_5/\Sigma A \times 100 \quad (2)$$

In Expression (2) above, $\Sigma A_5$ is a sum of areas of ferrite grains having an area of 5 $\mu m^2$ or less, and $\Sigma A$ is a sum of areas of all ferrite grains. That is, Expression (2) means a percentage of the sum of areas of fine ferrite grains having an area of 5 $\mu m^2$ or less per the sum of areas of all ferrite grains.

According to an embodiment of the present disclosure, the composition may be controlled such that a value of Expression (2) is 70 or more. According to the present disclosure, decomposition of the ferrite phase may be accelerated during the heat treatment process by controlling the sum of the areas of the fine ferrite grains at a high level as described above. As a result, a magnetic permeability may be 1.02 or less after heat treatment, particularly, a magnetic permeability may be 1.02 or less when a thickness is 1 mm or less.

The size distribution of the ferrite phase may be controlled using various processes as long as the value of Expression (2) is 70 or more. For example, the size distribution may be controlled by a forging or rolling process and controlled by adjusting a reduction ratio and the number of rolling in various ways. However, the above-described examples are made only for illustrative purposes, and the present disclosure is not limited thereby.

According to the present disclosure, the fraction of the ferrite phase may be controlled to be as low as possible by adjusting the alloy components, controlling the microstructure, or controlling both the alloy components and the microstructure as described above. Therefore, the present disclosure may provide a non-magnetic austenitic stainless steel applied as a material for various electronic devices.

Hereinafter, the present disclosure will be described in more detail with reference to the following examples. It should be noted, however, that the following examples are intended to illustrate the present disclosure in more detail and not to limit the scope of the present disclosure. The scope of the present disclosure may be determined by the matters described in the claims and the matters reasonably deduced therefrom.

EXAMPLES

Slabs having chemical compositions of alloy components shown in Table 1 below were prepared to a thickness of 200 mm by a continuous casting. Then, the cast slabs were reheated at a temperature of 1,250° C. for 2 hours. Subsequently, the reheated slabs were hot-rolled to a thickness of 6 mm and hot-annealed at a temperature of 1,150° C.

Values of Expression (1) shown in Table 1 are values obtained by substituting the content (wt %) of each alloy element of Table 1 into Expression (1) below.

$$3*(Cr+Mo)+5*Si-65*(C+N)-2*(Ni+Mn)-28 \quad (1)$$

In Expression (1), Cr, Mo, Si, C, N, Ni, and Mn denote contents (wt %) of the alloy elements, respectively.

Ferrite fractions of Table 1 were derived by measuring ferrite fractions of the hot-rolled, hot-annealed coils using a contact-type ferrite scope. When no value was obtained in a contact state, the ferrite fraction was determined as 0%.

TABLE 1

| Steel | Alloy composition (wt %) | | | | | | | | Expression | Ferrite fraction |
|---|---|---|---|---|---|---|---|---|---|---|
| type | C | Mn | Cr | Ni | Si | Mo | Cu | N | (1) | (%) |
| 1 | 0.022 | 1.00 | 21.2 | 10.0 | 0.97 | 0.52 | 0.21 | 0.157 | 8.38 | 6.3 |
| 2 | 0.015 | 0.66 | 17.7 | 12.1 | 0.61 | 2.07 | 0.27 | 0.013 | 7.02 | 1.9 |
| 3 | 0.024 | 0.67 | 17.7 | 12.1 | 0.67 | 2.04 | 0.28 | 0.020 | 6.17 | 1.3 |
| 4 | 0.030 | 0.80 | 21.3 | 9.3 | 0.40 | 0.60 | 0.80 | 0.200 | 4.55 | 1.2 |
| 5 | 0.019 | 1.06 | 16.1 | 10.1 | 0.47 | 2.04 | 0.29 | 0.014 | 4.43 | 1.6 |
| 6 | 0.027 | 0.92 | 21.4 | 9.4 | 0.39 | 0.54 | 0.82 | 0.207 | 3.92 | 0.1 |
| 7 | 0.041 | 0.83 | 20.6 | 10.9 | 0.97 | 0.54 | 0.21 | 0.164 | 3.49 | 0.4 |
| 8 | 0.022 | 0.80 | 21.3 | 10.1 | 0.39 | 0.60 | 0.81 | 0.200 | 3.42 | 0.2 |
| 9 | 0.029 | 0.97 | 21.2 | 9.5 | 0.37 | 0.51 | 0.76 | 0.209 | 2.57 | 0.7 |
| 10 | 0.026 | 0.78 | 21.2 | 9.3 | 0.40 | 0.58 | 0.84 | 0.240 | 1.89 | 0.3 |
| 11 | 0.029 | 0.95 | 21.2 | 9.5 | 0.33 | 0.55 | 0.75 | 0.218 | 1.95 | 1.0 |
| 12 | 0.030 | 0.80 | 21.3 | 10.3 | 0.40 | 0.60 | 0.80 | 0.220 | 1.25 | 0.1 |
| 13 | 0.030 | 1.95 | 21.6 | 13.7 | 1.00 | 0.00 | 0.99 | 0.125 | 0.43 | 0.2 |
| 14 | 0.027 | 0.86 | 21.4 | 10.2 | 0.39 | 0.58 | 0.72 | 0.238 | 0.55 | 0.8 |
| 15 | 0.031 | 3.07 | 20.7 | 10.9 | 0.97 | 0.00 | 2.03 | 0.133 | 0.35 | 0.7 |
| 16 | 0.032 | 2.88 | 20.7 | 10.0 | 1.01 | 0.00 | 2.00 | 0.172 | 0.13 | 0.4 |
| 17 | 0.030 | 2.05 | 17.1 | 10.0 | 1.49 | 0.50 | 1.99 | 0.096 | −0.04 | 0.0 |
| 18 | 0.029 | 2.06 | 17.0 | 10.0 | 1.48 | 0.76 | 2.00 | 0.104 | −0.09 | 0.0 |

TABLE 1-continued

| Steel type | Alloy composition (wt %) C | Mn | Cr | Ni | Si | Mo | Cu | N | Expression (1) | Ferrite fraction (%) |
|---|---|---|---|---|---|---|---|---|---|---|
| 19 | 0.031 | 2.03 | 18.8 | 10.0 | 0.96 | 0.00 | 2.01 | 0.114 | −0.29 | 0.0 |
| 20 | 0.020 | 2.02 | 17.0 | 9.1 | 1.48 | 0.50 | 1.99 | 0.140 | −0.74 | 0.0 |
| 21 | 0.025 | 2.00 | 18.0 | 8.0 | 0.99 | 0.00 | 1.98 | 0.156 | −0.82 | 0.0 |
| 22 | 0.032 | 1.96 | 19.9 | 9.0 | 1.01 | 0.00 | 2.01 | 0.209 | −0.84 | 0.0 |
| 23 | 0.025 | 0.86 | 21.2 | 9.4 | 0.42 | 0.54 | 0.79 | 0.280 | −1.03 | 0.0 |
| 24 | 0.025 | 0.96 | 20.4 | 12.4 | 0.97 | 0.20 | 0.30 | 0.179 | −1.33 | 0.0 |
| 25 | 0.031 | 2.00 | 20.3 | 10.9 | 0.99 | 0.00 | 0.99 | 0.180 | −1.67 | 0.0 |
| 26 | 0.023 | 1.27 | 17.3 | 14.4 | 0.45 | 2.55 | 0.00 | 0.048 | −2.16 | 0.0 |
| 27 | 0.024 | 1.31 | 17.3 | 14.6 | 0.47 | 2.54 | 0.20 | 0.049 | −2.70 | 0.0 |
| 28 | 0.033 | 1.98 | 17.9 | 7.8 | 1.01 | 0.00 | 2.00 | 0.197 | −3.76 | 0.0 |
| 29 | 0.050 | 1.02 | 20.3 | 12.1 | 0.93 | 0.00 | 0.00 | 0.200 | −4.94 | 0.0 |
| 30 | 0.097 | 0.98 | 20.5 | 12.2 | 0.98 | 0.00 | 0.00 | 0.210 | −7.92 | 0.0 |

Referring to Table 1, because Steel Types 17 to 30 satisfy the alloy composition range limited by the present disclosure and values of Expression (1) thereof are negative values, ferrite fractions thereof were 0%. On the contrary, because values of Expression (1) of Steel Types 1 to 16 are positive values, ferrite remains after heat treatment although the alloy compositions of Steel Types 1 to 16 are within the range provided in the present disclosure.

FIG. 1 is a graph illustrating changes in ferrite fractions according to values of Expression (1) of Table 1. Referring to FIG. 1, it may be confirmed that the ferrite fraction tends to increase at a point where the value of Expression (1) is changed from 0 to a positive value. That is, as a result of controlling the value of Expression (1) to be a negative value, it may be visually confirmed that the ferrite fraction tends to be 0% based on FIG. 1.

Based on the above-described results, the ferrite fraction may be controlled to be 0% by adjusting the value of Expression (1) to be a negative value. As a result, target non-magnetic properties may be obtained.

Meanwhile, even in the case of Steel Types 1 to 16 having ferrite fractions exceeding 0.0%, a magnetic permeability may be controlled at a low level by accelerating decomposition of ferrite by controlling the microstructure. Evaluation results of Table 2 below were obtained from Steel Types 1 to 16 in which the ferrite phase remains since the ferrite fraction exceeded 0.0%. The hot-rolled coils of Steel Types 1 to 16 having a thickness of 6 mm were cold-rolled to a thickness of 1 mm or less and annealed.

Values of Expression (2) shown in Table 2 were derived by image analysis using an optical microscope after the cold rolling.

Ferrite fractions of Table 2 were derived by measuring ferrite fractions of the cold-rolled, cold-annealed coils using a contact-type ferrite scope. When no value was obtained in a contact state, the ferrite fraction was determined as 0%.

Magnetic permeabilities (μ) shown in Table 2 were measured using a Ferromaster that is a contact-type magnetic permeability meter. Steel Types 1 to 16 were cold-rolled to a thickness of 1 mm or less by applying various reduction ratios.

TABLE 2

| Steel type | Thickness (mm) | Expression (2) | Ferrite fraction (%) | Magnetic permeability (μ) |
|---|---|---|---|---|
| 1 | 0.5 | 45.29 | 2.4 | 1.247 |
| | 0.3 | 59.15 | 1.0 | 1.063 |

TABLE 2-continued

| Steel type | Thickness (mm) | Expression (2) | Ferrite fraction (%) | Magnetic permeability (μ) |
|---|---|---|---|---|
| 2 | 1.0 | 60.49 | 0.8 | 1.046 |
| | 0.8 | 75.28 | 0.0 | 1.018 |
| 3 | 1.0 | 62.48 | 0.6 | 1.036 |
| | 0.8 | 78.59 | 0.0 | 1.016 |
| 4 | 0.5 | 64.26 | 0.7 | 1.041 |
| | 0.3 | 71.63 | 0.0 | 1.012 |
| 5 | 0.5 | 62.83 | 0.7 | 1.042 |
| | 0.3 | 76.13 | 0.0 | 1.017 |
| 6 | 0.5 | 81.55 | 0.0 | 1.006 |
| | 0.2 | 80.71 | 0.0 | 1.004 |
| 7 | 0.5 | 73.59 | 0.0 | 1.008 |
| | 0.3 | 83.02 | 0.0 | 1.003 |
| 8 | 1.0 | 75.67 | 0.0 | 1.008 |
| | 0.8 | 85.56 | 0.0 | 1.003 |
| 9 | 1.0 | 72.85 | 0.0 | 1.019 |
| | 0.8 | 74.15 | 0.0 | 1.009 |
| 10 | 1.0 | 79.32 | 0.0 | 1.010 |
| | 0.3 | 81.57 | 0.0 | 1.005 |
| 11 | 1.0 | 56.94 | 0.3 | 1.023 |
| | 0.5 | 71.10 | 0.0 | 1.012 |
| 12 | 0.5 | 76.37 | 0.0 | 1.009 |
| | 0.3 | 81.87 | 0.0 | 1.005 |
| 13 | 0.5 | 83.68 | 0.0 | 1.004 |
| | 0.3 | 84.64 | 0.0 | 1.003 |
| 14 | 1.0 | 66.96 | 0.3 | 1.021 |
| | 0.2 | 78.91 | 0.0 | 1.006 |
| 15 | 1.0 | 68.01 | 0.4 | 1.027 |
| | 0.2 | 80.03 | 0.0 | 1.006 |
| 16 | 0.5 | 72.14 | 0.0 | 1.012 |
| | 0.3 | 79.80 | 0.0 | 1.006 |

Referring to Table 2, when the microstructure is controlled such that the value of Expression (2) is 70 or more, remaining ferrite is completely decomposed during the annealing process after the rolling process so that the ferrite fraction becomes 0.0%. As a result, magnetic permeabilities of 1.02 or less may be obtained. On the contrary, when the value of Expression (2) is less than 70, remaining ferrite is not completely decomposed during the annealing process after the rolling process, so that the magnetic permeability exceeds 1.02.

FIG. 2 is a graph illustrating changes in magnetic permeability according to values of Expression (2) of Table 2. Referring to FIG. 2, it may be confirmed that the magnetic permeability tends to be less than 1.02 at a point where the value of Expression (2) is exceeds 70. That is, in the present disclosure, when the value of Expression (2) is controlled to be 70 or more, it may be visually confirmed that the magnetic permeability tends to be 1.02 or less based on FIG. 2.

Based on the above-described results, even when ferrite remains after the hot rolling and annealing process, desired non-magnetic properties may be obtained by accelerating decomposition of remaining ferrite during the cold annealing process after the cold rolling process by controlling the value of Expression (2) to be 70 or more.

While the present disclosure has been particularly described with reference to exemplary embodiments, it should be understood by those of skilled in the art that various changes in form and details may be made without departing from the spirit and scope of the present disclosure.

The invention claimed is:

1. A non-magnetic austenitic stainless steel comprising, in percent by weight (wt %), 0.01 to 0.1% of carbon (C), 1.5% or less (excluding 0) of silicon (Si), 0.5 to 3.5% of manganese (Mn), 16 to 22% of chromium (Cr), 7 to 15% of nickel (Ni), 3% or less of molybdenum (Mo), 0.01 to 0.3% of nitrogen (N), and the remainder of iron (Fe) and inevitable impurities, wherein the austenitic stainless steel comprises more than 0% by area fraction of the ferrite phase, wherein a magnetic permeability is 1.02 or less when a thickness is 1 mm or less, wherein a value of Expression (2) below is 70 or more:

$$\Sigma A5/\Sigma A\times 100 \quad (2)$$

(wherein in Expression (2), $\Sigma A_5$ is a sum of areas of ferrite grains having an area of 5 μm2 or less, and ΣA is a sum of areas of all ferrite grains).

2. The non-magnetic austenitic stainless steel of claim 1, further comprising, in percent by weight (wt %), 2.5% or less of copper (Cu).

* * * * *